US006659023B2

(12) United States Patent
Saltzman et al.

(10) Patent No.: US 6,659,023 B2
(45) Date of Patent: Dec. 9, 2003

(54) TILE-TOPPED FURNITURE WITH REMOVABLE TILES

(76) Inventors: Glenn Lisa Saltzman, 8 Noble St., West Haven, CT (US) 06516; Mark Bocchetti, 8 Noble St., West Haven, CT (US) 06516

( * ) Notice: Subject to any disclaimer, the term of this patent is extended or adjusted under 35 U.S.C. 154(b) by 15 days.

(21) Appl. No.: 10/027,254

(22) Filed: Dec. 26, 2001

(65) Prior Publication Data

US 2002/0102379 A1 Aug. 1, 2002

Related U.S. Application Data

(60) Provisional application No. 60/264,517, filed on Jan. 26, 2001.

(51) Int. Cl.[7] ..... A47B 13/00
(52) U.S. Cl. ..... 108/161; 108/90
(58) Field of Search ..... 108/161, 90, 13, 108/11

(56) References Cited

U.S. PATENT DOCUMENTS

| | | | |
|---|---|---|---|
| 76,459 | A | 4/1868 | Hubbard |
| 1,196,698 | A | 8/1916 | Keller |
| 3,062,604 | A | 11/1962 | Hodgen |
| 3,150,032 | A | 9/1964 | Rubenstein |
| 3,174,893 | A | 3/1965 | Church et al. |
| 3,212,952 | A | 10/1965 | Turner |
| 3,610,175 | A | 10/1971 | Wilton |
| 3,688,707 | A | 9/1972 | White |
| 4,484,745 | A | 11/1984 | Sleeper |
| 4,761,931 | A | 8/1988 | Schrunk |
| 5,244,255 | A | 9/1993 | Hill |
| 5,694,865 | A | 12/1997 | Raab |

*Primary Examiner*—Jose V. Chen
(74) *Attorney, Agent, or Firm*—Law Offices of Royal W. Craig

(57) ABSTRACT

An article of furniture bearing a plurality of tiles on a top surface. A frame is disposed on the top surface for removably securing said tiles thereon. The frame comprises an external frame member surrounding and forming a border along the top surface, and an internal frame comprising a centrally disposed spine with a plurality of ribs extending outward from the spine at regularly spaced intervals. The internal frame is seated within the external frame and subdivides the area therein into a plurality of recesses. The tiles are removably seated within the recesses anywhere within the table top grid, and they can be rearranged on the surface within the recesses according to the whim of the user. Each tile bears a distinctive color or finish, and the user may arrange the tiles on the surface of the table according to his or her whim, for purposes of artistic expression, or purely for entertainment.

11 Claims, 4 Drawing Sheets

TILE-TOPPED FURNITURE WITH REMOVABLE TILES

CROSS-REFERENCE TO RELATED APPLICATIONS

The present application derives priority from U.S. Provisional Patent Application No. 60/264,517 for "TILE-TOPPED FURNITURE WITH REMOVABLE TILES", filed Jan. 26, 2001.

BACKGROUND OF THE INVENTION

1. Field of the Invention

The present invention relates to furniture and, more particularly, to furniture having a surface of removable and interchangeable decorative tiles.

2. Description of the Background

Furnishings fulfill multiple needs and may combine both functional and ornamental characteristics. A dinner table, for example, provides a structure around which meals are eaten. End tables hold lamps, books, telephones and the like. Coffee tables offer a place to set drinks, place periodicals, or prop your feet. In addition to its functional characteristics, furniture may be decorative. A dresser may be specifically chosen to adorn a particular room because its ornamental character complements the interior design of the room.

As an extension of both utilitarian and decorative attributes, some furniture provides a means for artistic expression or entertainment to its users. Examples of this sort of interactive furniture are not as well known in the prior art. Nevertheless, U.S. Pat. No. 4,599,254 to Cuttica shows an article of furniture comprising an array of adjustable tiles. Cuttica '254, however, teaches an array of tiles retained in a frame which allows the tiles to be rearranged only by sliding them within the framework. Unfortunately, the tiles in the Cuttica arrangement can not be removed from the framework, and expression is thereby limited by the physical restraints imposed by the fixed grid in which the tiles slide. Moreover, the table top as taught by Cuttica always has a gap or unoccupied space to accommodate sliding the next tile.

U.S. Pat. No. 3,438,840 to George describes an article having a decorative surface comprising a wooden block However, George '840 teaches a means of permanently attaching the decorative surface to a wooden block. While George '840 could ostensibly be used as an article of furniture, no such use is taught, nor does George teach arranging the decorative block elements on the surface of furniture as a means of artistic expression.

In light of the foregoing, it would be of great advantage to create an improved article of furniture with a decorative tile surface which enables one to easily rearrange the tiles and change the appearance of the table-top design in a manner unencumbered by the structure of the tile-supporting grid.

SUMMARY OF THE INVENTION

It is, therefore, an object of the present invention to present a movable array of tiles on the surface of an article of furniture.

It is another object of the present invention to seat the tiles in a framework mounted to the top surface of the article of furniture.

It is yet another object to remove and replace the tiles at any location within the grid of the table top frame.

A still further object of the invention is to present a medium for decorative or artistic expression by providing a framework within which an owner can vary tiles of different colors or finishes to produce unique and distinctive effects, similar to a mosaic.

According to the present invention, the above-described and other objects are accomplished by providing an article of furniture carrying a plurality of tiles on a top surface. A frame is disposed on the top surface for removably securing said tiles thereon. The frame comprises an external frame member surrounding and forming a border along the top surface, and an internal frame comprising a centrally disposed spine with a plurality of ribs extending outward from the spine at regularly spaced intervals. The internal frame is seated within the external frame and subdivides the area therein into a plurality of recesses. The tiles are removably seated within the recesses anywhere within the table top grid, and they can be rearranged on the surface within the recesses according to the whim of the user. Each tile bears a distinctive color or finish, and the user may arrange the tiles on the surface of the table according to his or her whim, for purposes of artistic expression, or purely for entertainment.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is a configuration of removable and interchangeable decorative tiles (inclusive of the surface and support system therefor) for an article of furniture. The invention will hereafter be described with reference to an embodiment representing a tile-topped table 2, but it should be understood that the invention may be practiced with any article of furniture that has an exposed, horizontal load-bearing surface. For example, the invention may be incorporated into tables, dressers, night stands, bureaus, countertops, shelving, and the like.

Figure 1:
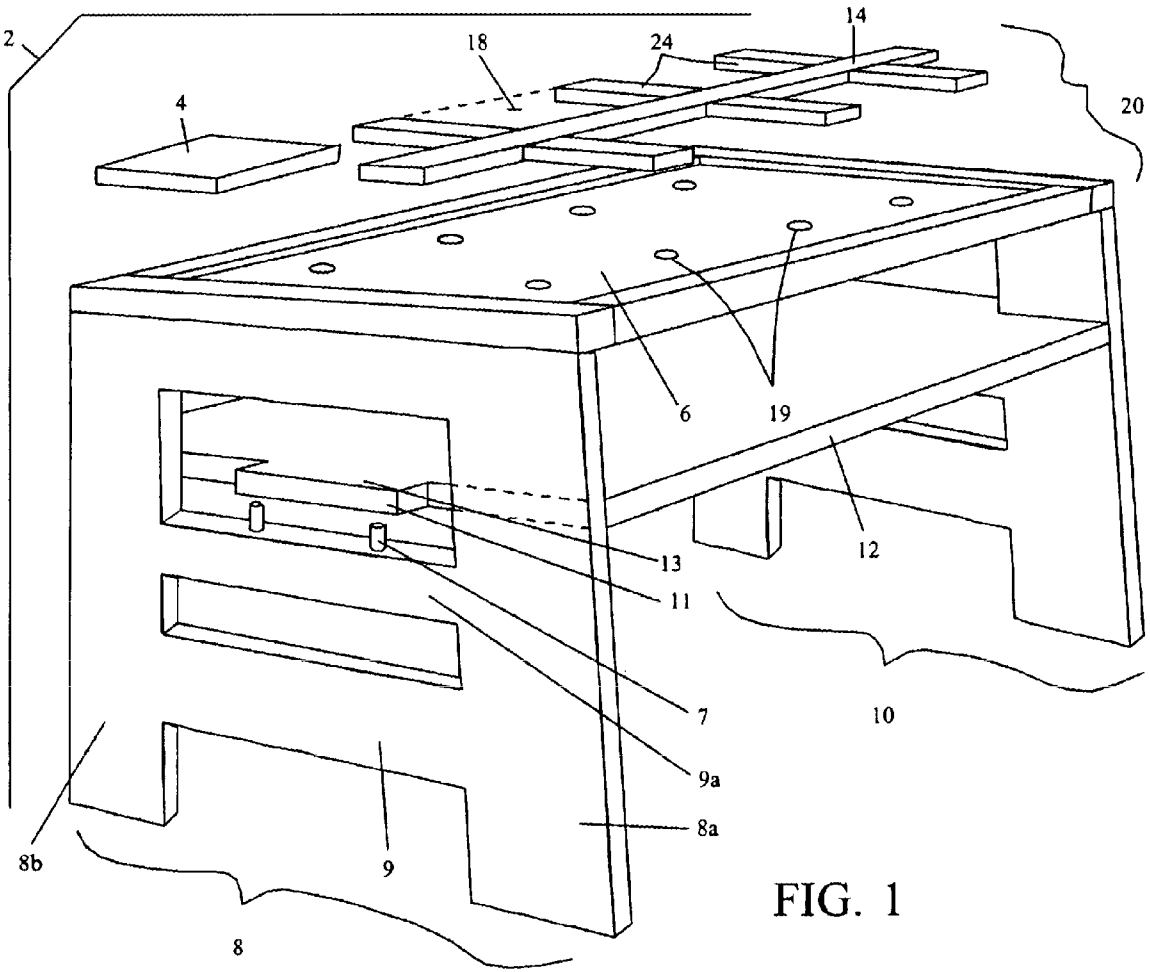
FIG. 1 is an exploded view of one embodiment of the present invention representing a tile-topped table.

As best seen in FIG. 1, the tile-topped table 2 generally comprises a tile-topped surface 20 formed from a horizontally disposed, recessed top surface 6 bearing a plurality of inlaid tiles 4. The tile-topped surface 20 is supported beneath by a pair of folding, opposing heavy-duty leg assemblies 8, 10. A cross-member 12 comprises a plank and engages leg assemblies 8, 10 holding the folded legs open and adding strength to the structure. A raised skeletal internal frame 14 lies on the top surface 6, and is bordered by a raised surrounding external frame 16 which lies along the outer margin of the top surface 6. Tiles 4 are held within recesses 18 defined by the internal frame 14. The underlying top surface 6 may comprise a sheet of plywood, particle board or like material. In the illustrated embodiment the top surface 6 forms a shelf on which tiles 4 rest directly.

Figure 2:
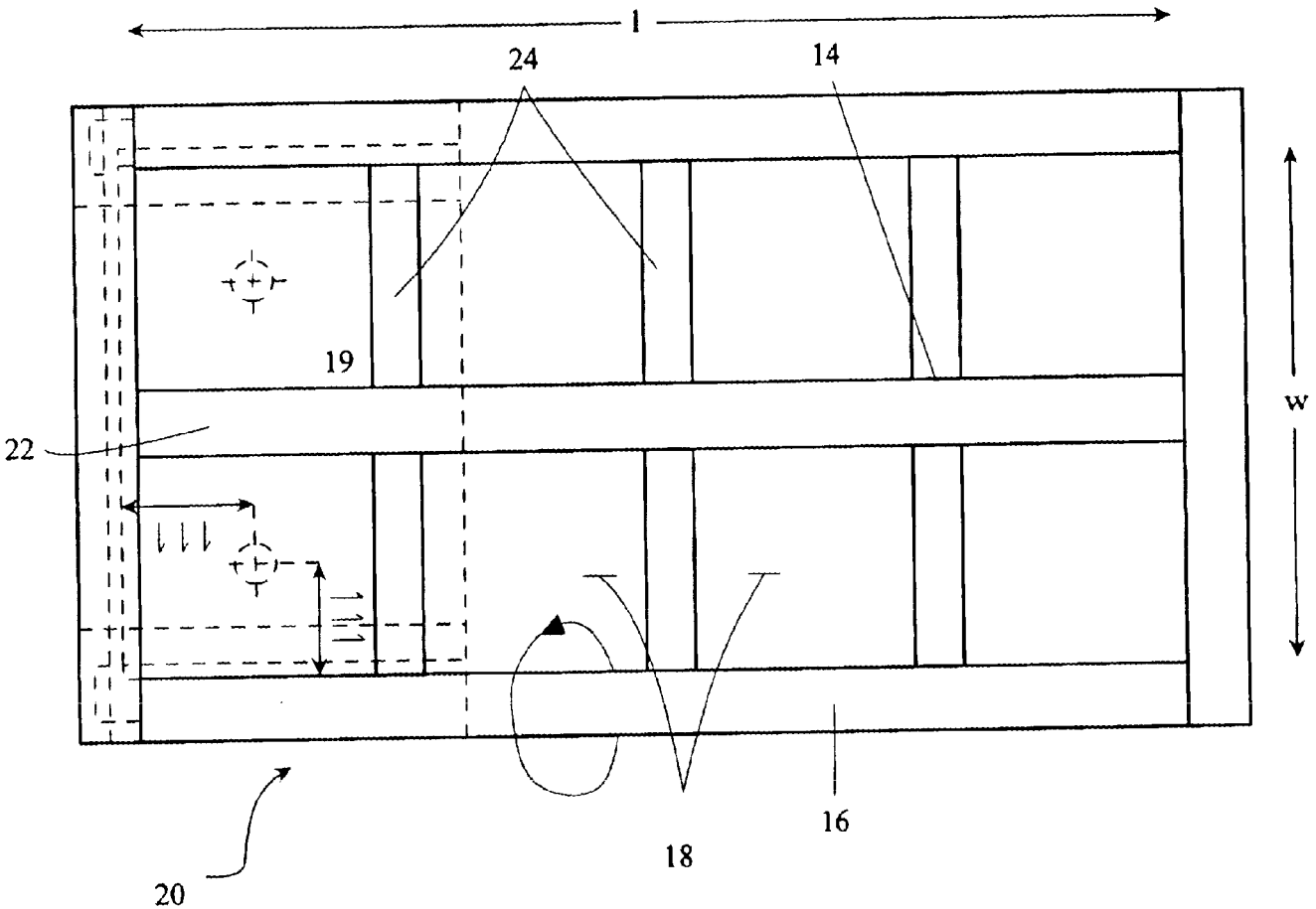
FIG. 2 is top view of a tile-topped surface according to the present invention.

FIG. 2 shows a top view of tile-topped surface 20. The external frame 16 forms a border along the top surface 20 and defines the outer margin of the structure. The internal frame 14 comprises a centrally disposed spine 22 which runs the length of top surface 6 parallel to the sides of the external frame 16 and confined within the ends of frame 16 (therein defining the length dimension 1 of the top surface). A plurality of ribs 24 extend from the spine 22 at regularly spaced intervals, each rib extending perpendicularly from the spine and out to the sides of external frame 16 (therein defining the width dimension w of the top surface). So arranged, the internal frame 14 and external frame 16 define recesses 18. Recesses 18 as defined by the above-described internal frame are square or rectangular in shape, but it should be understood that neither the structure of the top surface nor the internal frame is necessarily limited to a structure composed of right angles. Accordingly, the recesses 18 may comprise shapes other than a parallelogram. Holes 19 are present on top surface 6, and one hole 19 corresponds to each recess 18.

Tiles 4 fit snugly into recesses 18. Each tile 4 is an individual unit having a uniform length, width and height dimension. The exposed face 62 of each tile 4 carries an image, pattern, color, texture or similar decorative finish. If a user wishes to remove a tile, she may insert her finger through hole 19 and push tile 4 up from the underside, and out of the framework.

Figure 3:
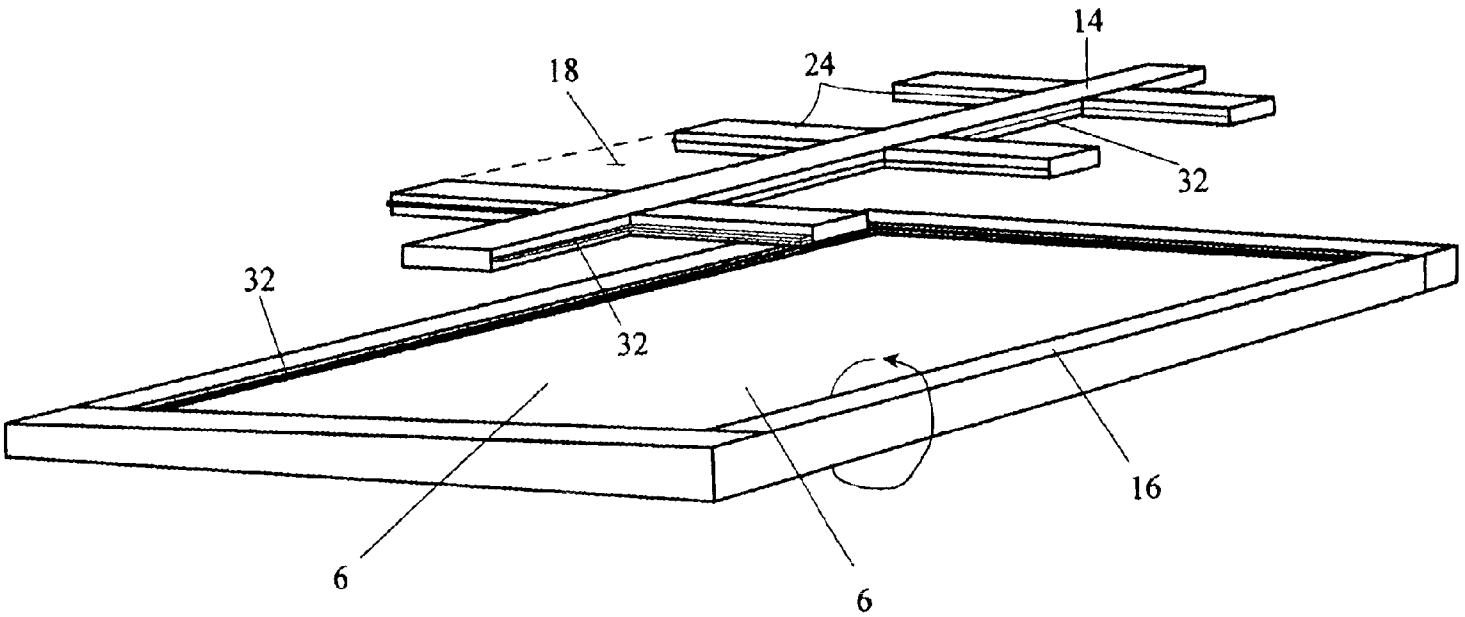
FIG. 3 is a perspective view of a frame of an alternative embodiment in which the frame comprises ledges to support the tiles.

In an alternative embodiment, as shown in FIG. 3, the inner margins of the internal frame 14 and external frame 16 (which collectively define recesses 18) can be equipped with a ledge 32. Ledge 32 may be a separate component attached by nails, wood screws, wood glue or the like. Alternatively, ledge 32 may be formed by routering the inner margins of internal frame 14 and external frame 16. Ledge 32 extends parallel to top surface 6 and partially into the interior of recesses 18, and provides a seat on which tiles 4 (not shown in FIG. 3) may rest. In this embodiment, a clearance is introduced between the top surface 6 as defined by the external frame 16, and the tiles.

Figure 4:
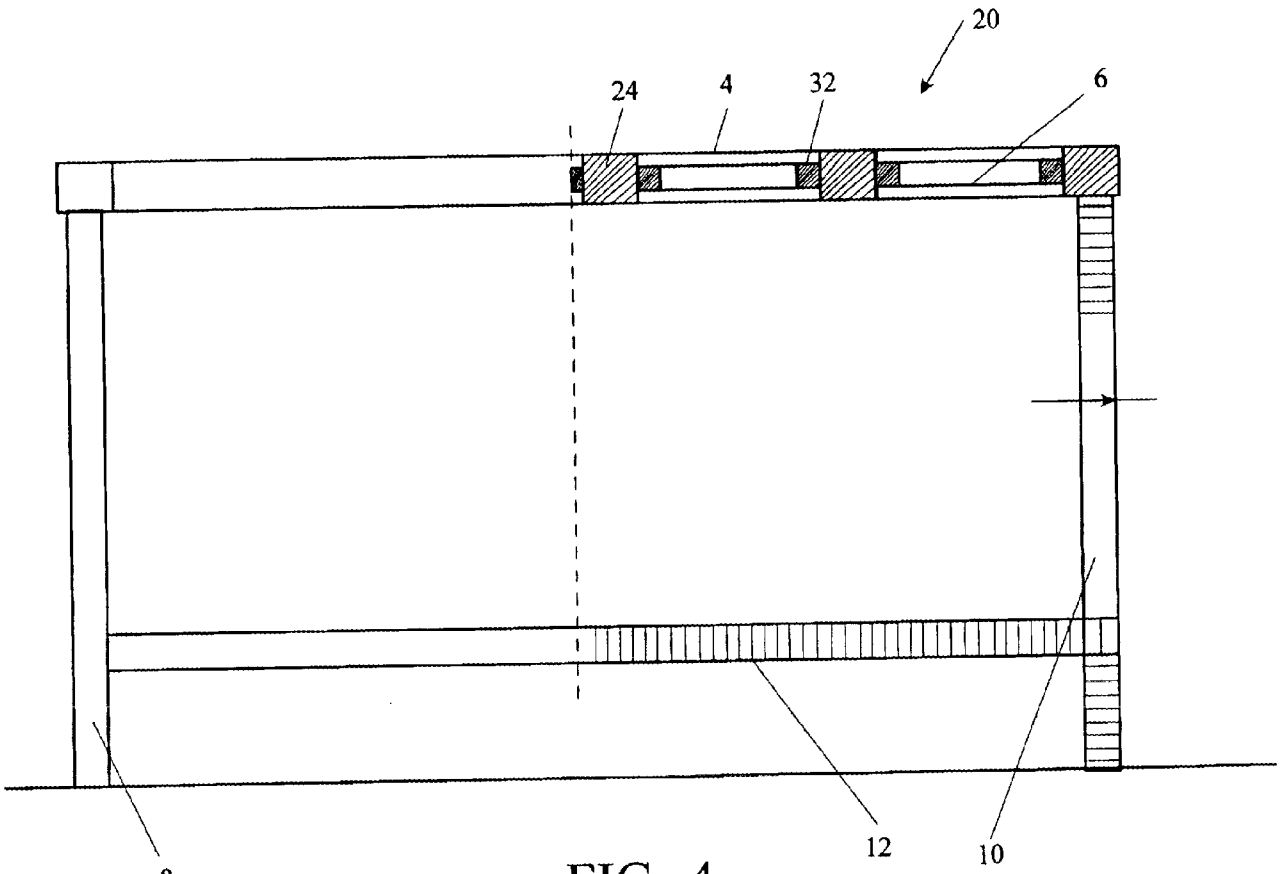
FIG. 4 is a side view of an embodiment representing a tile-topped table with a partial cut-away view of the tile-topped surface.

FIG. 4 is a side view of a table as in FIG. 3 with partial cut-away view of tile-topped surface 20. The butt ends of ribs 24 are spaced at regular intervals along the periphery of the top surface 6. Ledge 32 attaches perpendicularly along the margins of ribs 24, and supports tiles 4 from beneath. As shown in FIG. 4, leg assemblies 8, 10 rise vertically from the ground and engage the underside of top surface 6 at right angles. Cross-member 12 braces leg assemblies 8, 10 and lies horizontally beneath and parallel to top surface 6. Leg assemblies 8, 10 may further attach to top surface 6 by hinges.

Referring back to FIG. 1, an exemplary leg assembly 8 (as used in the embodiments of FIGS. 1–4 comprises two vertically disposed legs 8*a* and 8*b* spaced apart in a parallel configuration. A plurality of integral cross-braces 9 link legs 8*a* and 8*b* in a perpendicular configuration. One brace 9*a* supports cross-member 12. A plurality of dowels 7 extend upwardly from the brace 9*a* and engage the corresponding bore holes 11 in cross-member 12. A notched lip 13 protruding from each end of cross-member 12 carries bore holes 11, and rests on the upper margin of brace 9*a*. Alternatively, cross-member 12 carries dowels 7, and brace 9*a* carries corresponding bore holes 11. After first removing cross-member 12 by disengaging the dowels 7 from the bore holes 11, the hinges enable leg assemblies 8, 10 to fold inwardly under the tile bearing surface.

The tile-topped furniture as constructed and used as described above meets the traditional needs for practicality and beauty often sought from furniture, but further offers an interactive and entertaining means for creative expression. Users may freely remove and replace tiles and create an ever-changing pattern of images on the surface of the furniture. As a table, the invention may find favor with restaurant, bar, or cafe owners as patrons amuse themselves by re-arranging the tile assemblies before or after a meal, drinks, or coffee. As a dresser, the invention may find favor with manufacturers of children's furnishings. The invention may be used in countless other commercial and consumer furniture applications including coffee tables, end tables, shelving, etc., and the above-described uses are exemplary and not intended as a finite list of applications.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

We claim:

1. An article of furniture comprising:

(a) a top surface;

(b) a plurality of removable tiles;

(c) a frame for removably securing said tiles on said top surface, said frame further comprising an internal frame member including a central spine bearing ribs at evenly spaced intervals, and an external frame member surrounding said internal frame member, said external frame member defining a periphery of said frame, whereby said internal frame member creates recesses within the external frame member to laterally confine said tiles therein;

whereby said tiles may be rearranged on said top surface by a user.

2. The article of furniture as recited in claim 1, wherein said top surface comprises a plurality of holes to facilitate the removal of said tiles, and each of said holes is in communication with one of said recesses.

3. The article of furniture as recited in claim 1 wherein said frame comprises ledges around the internal frame member and around the interior of the external frame member, whereby tiles seated within said frame are supported from beneath by said ledges.

4. The article of furniture as recited in claim 1, further comprising a pair of leg assemblies each including two parallel and vertically disposed legs centrally attached by perpendicular braces, at least one of said braces bearing a plurality of upwardly extending dowels; and a horizontal support structure comprising a plank carrying ends notched to fit securely between said two vertically disposed legs, said ends further bearing a centrally disposed lip which extends between said legs, said lip bearing bore holes which mate with dowels extending upwardly from braces attached in a perpendicular configuration to said legs.

5. An article of furniture comprising:

a top surface;

a plurality of removable tiles; and a frame for removably securing said tiles on said top surface, said frame further comprising an external frame member surrounding and forming a border along the top surface, and an internal frame comprising a centrally disposed spine having plurality of ribs extending outward from the spine at regularly spaced intervals, said internal frame being seated within the external frame and subdividing the area therein into a plurality of recesses;

whereby said tiles may be rearranged on said surface within said recesses according to the whim of the user.

6. The article of furniture as recited in claim 5, wherein said tiles are each shaped as a parallelogram.

7. The article of furniture as recited in claim 5, wherein said top surface comprises a plurality of holes to facilitate the removal of said tiles, and each of said holes is in communication with one of said recesses.

8. The article of furniture as recited in claim 7, wherein said frame comprises ledges around the internal frame member and around the interior of the external frame member, whereby tiles seated within said frame are supported from beneath by said ledges.

9. The article of furniture as recited in claim 5, further comprising a pair of leg assemblies each further comprising two parallel and vertically disposed legs centrally attached by perpendicular braces, at least one of said braces bearing a plurality of upwardly extending dowels.

10. The article of furniture as recited in claim 9, further comprising a horizontal support structure comprising a plank carrying ends notched to fit securely between said two vertically disposed legs, said ends further bearing a centrally disposed lip which extends between said legs, said lip bearing bore holes which mate with dowels extending upwardly from braces attached in a perpendicular configuration to said legs.

11. The article of furniture as recited in claim 9, wherein each of said leg assemblies comprise hinges to fold said leg assemblies under said top surface, whereby said article of furniture is easily broken down and transported.

* * * * *